United States Patent [19]

Dilg

[11] 4,022,329

[45] May 10, 1977

[54] DRAFT RIGGING FOR RAILWAY CARS

[75] Inventor: Walter Cabble Dilg, Elma, N.Y.

[73] Assignee: Dresser Industries, Inc., Dallas, Tex.

[22] Filed: Jan. 16, 1976

[21] Appl. No.: 649,890

[52] U.S. Cl. ..... 213/67 R; 213/64

[51] Int. Cl.[2] ..... B61G 9/06

[58] Field of Search ..... 213/8, 60, 61, 62 R, 213/63, 64, 67 R, 67 A, 69, 69 S, 70–72; 188/1 C

[56] References Cited

UNITED STATES PATENTS

| | | | |
|---|---|---|---|
| 1,968,789 | 7/1934 | Townsend | 213/67 R |
| 2,271,907 | 2/1942 | Wilson | 213/60 |
| 2,307,409 | 1/1943 | Kinne et al. | 213/67 R |
| 2,646,895 | 7/1953 | Travilla | 213/61 |
| 2,937,769 | 5/1960 | Blattner | 213/61 |
| 3,239,073 | 3/1966 | Danielson et al. | 213/67 R X |
| 3,351,214 | 11/1967 | Herbert | 213/62 R X |

*Primary Examiner*—Drayton E. Hoffman
*Assistant Examiner*—Fred A. Silverberg
*Attorney, Agent, or Firm*—R. T. Majesko; J. N. Hazelwood

[57] ABSTRACT

The invention relates to a rapid transit draft rigging for an automatic coupler which includes a yoke, disposed within a drawbar, which has a stem abutment extending inwardly from the rear of the yoke, passing through a shear block release member and contacting the rear surface of a follower block which is adjacent a cushioning member.

8 Claims, 4 Drawing Figures

DRAFT RIGGING FOR RAILWAY CARS

In subway and other railway cars, buffing and draft forces between connected or coupled cars normally are transmitted to the underframes of the cars through draft gears or other suitable cushioning devices contained in their draft rigging. However, particularly in the case of subway cars, it is desirable that the draft riggings and underframes be protected from damage by abnormal buffing forces, such as experienced in collisions, by causing such forces to be transmitted directly between the bodies of the cars. This has been accomplished in the past by providing one or each of the connected cars with a releasing draft rigging within the drawbar which, while enabling the car bodies normally to be spaced by their couplers or other connecting means, will release under buffing forces above a predetermined level and by telescoping of the connecting means into one or either car, to produce direct contact between the adjoining ends of the car bodies.

An object of the present invention is to provide an improved releasing draft rigging which not only releases under abnormal buffing forces, but is readily restorable to its initial condition.

Another object of the invention is to provide a rapid transit type automatic coupler drawbar assembly that has the ability to release under excessive impact force preventing damage to parts therein and permitting anti-climbers at the end of the cars to engage and thus maintain the cars in the upright position.

Other objects and advantages of the invention will be apparent from the following detailed description and drawings, in which.

Figure 1:
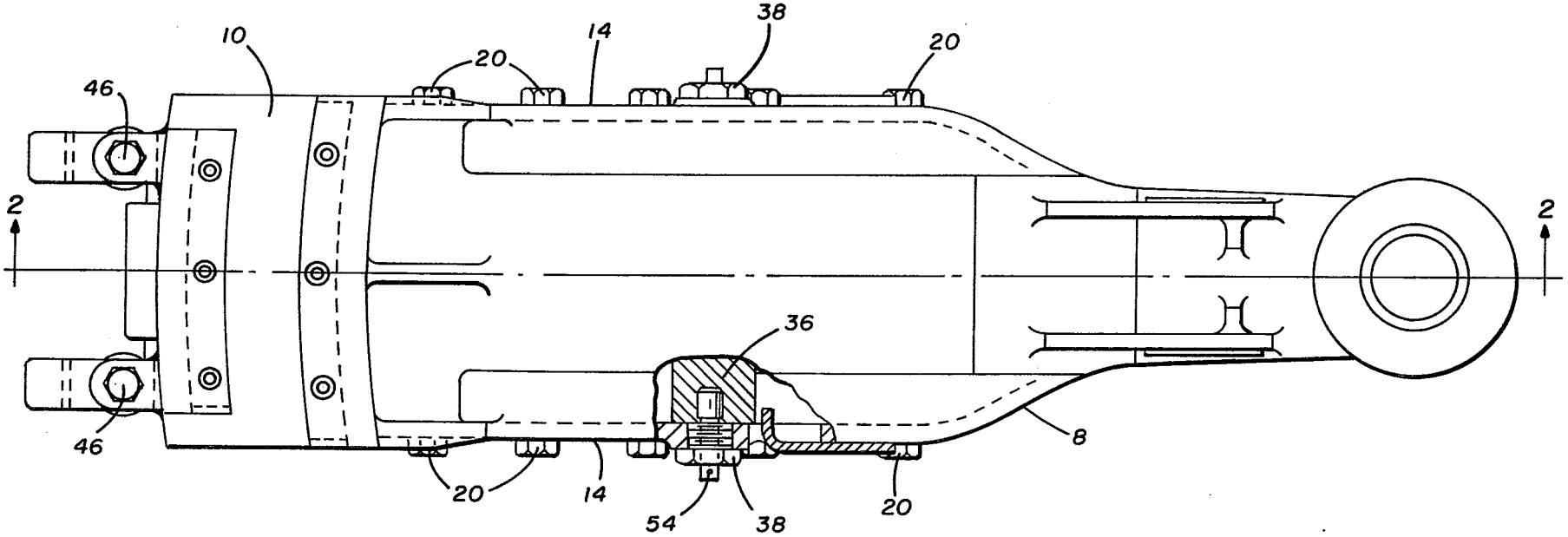
FIG. 1 is a plan view, partly in cross section of a preferred embodiment of the draft gear rigging of the present invention.

In accordance with the present invention, there is provided a draft rigging for a railway car. The rigging comprises a drawbar having a forward and rearward end and a pocket for a cushioning means. A yoke is disposed within the pocket. The yoke contains a pair of transversely spaced longitudinally extending straps. The straps are connected forwardly by tie-bars or a yoke head for pivotal connection to a coupler. They are connected rearwardly by a transverse rear wall. The rear wall contains a substantially centrally located longitudinal stem abutment member extending inwardly toward the yoke head.

Referring to the drawings, in which like reference characters designate like parts, the improved draft rigging of the present invention, while otherwise usable, probably will find its principal use in sub-way and like cars. It, therefore, is a draft rigging for such a car that has been illustrated as exemplary of the invention.

The illustrated draft rigging is used in conjunction with an automatic subway-type coupler (not shown) such as is illustrated in U.S. Pat. No. 3,181,708, issued May 4, 1965 and assigned to the assignee of the present invention, which is adapted to interlock against relative movement with a mating coupler. The coupler (not shown) is connected for relative vertical swinging to a yoke 2 by a horizontal pivot pin 4 and is yieldably held at coupling height by a spring-pressed plunger 6 depending from the yoke. A drawbar 8 which contains the yoke, is pivoted at the rear on an anchor member (not shown) for horizontal swinging. The anchor member is attached to the under-frame (not shown) of the subway or like car (not shown). The drawbar 8 is supported at the front on the usual radial carrier bar (not shown) which it receives in a slot 10 mounted on the drawbar.

The drawbar 8 is formed intermediate its ends as a housing containing a pocket 12 open at the bottom and front and bounded at the sides by laterally spaced sidewalls 14 and at the rear by a rear wall or horizontal pivot bearing 16. The pocket 12, which is subtantially rectangular in horizontal cross-section is closed at the bottom by a carrier or cover 18 bolted with bolts 20 or otherwise secured or fixed to the drawbar.

The yoke 2, which is conveniently cast, is mounted in the housing pocket 12 of the drawbar 8 for relative longitudinal movement therewithin. The yoke contains a pair of transversely spaced longitudinally extending straps 22. The straps are connected at the front by a tie-bar 24 and yoke head 26 for pivotal connection to a coupler. The straps are connected at the rear by a transverse rear wall 28. The rear wall contains a substantially centrally located longitudinal stem abutment member 30 which extends inwardly towards the yoke head. As illustrated in the drawing, the stem abutment member is T-shaped in cross-section as viewed in side elevation and cruciform in cross-section as viewed in a vertical plane at right angles to the longitudinal center line.

The stem abutment member 30 extends into the housing 32 of the yoke and passes through an aperture 34 in the shear block 36 which is attached to the sidewalls 14 of the drawbar by means of shear pins 38.

Also, housed or contained in the housing, is a rubber or other cushioning member 40 suitable for cushioning the draft and normal or ordinary buffing forces transmitted to it from the coupler through the yoke. Disposed in abutment with the cushioning member is a front and rear follower, 42 and 44 respectively. The front follower 42 is in contact with the tie-bar 24 and the rear follower 44 is in contact with the longitudinal stem abutment member 30. The shear pins 38 securing the shear block 36 are adapted to shear at a predetermined force in the event of a collision, and when this occurs, the yoke containing the cushioning member, shear block and coupler, slides rearwardly within the drawbar a sufficiently long distance to prevent damage caused by an accident that deforms the end of the car. The shear block 36 maintains its center position because of the stem abutment member passing therethrough. The drawbar contains elastomer pads 45 secured to the front with bolts 46, which pads contact the head 26 of the yoke to help stabilize and return it to a vertical position.

The drawbar and yoke may have wear plates 48 and 50, respectively secured to opposed surfaces thereof to provide longer life for these parts.

Figure 3:
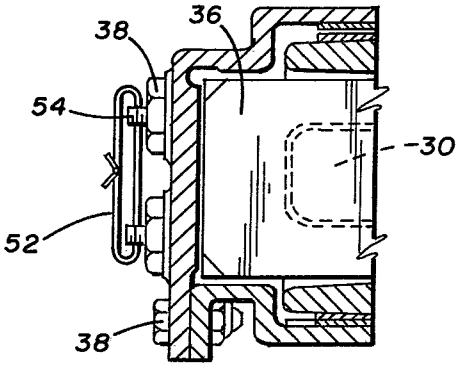
FIG. 3 is a front elevation view, partly in cross-section, taken along lines 3—3 of FIG. 2.
Figure 2:
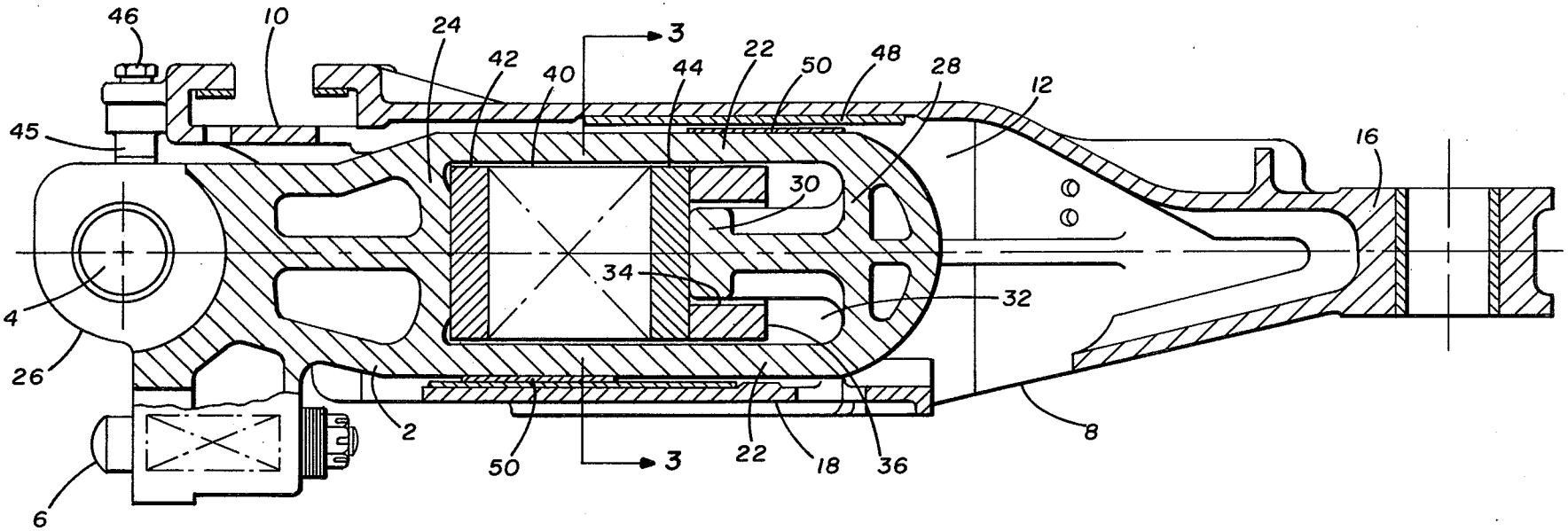
FIG. 2 is a side elevation view, partly in cross-section, taken along line 2—2 of FIG. 1.

As shown in FIG. 3, the shear pins can be locked against turning by looping a lock wire 52 through a hole in the tongue 54 of each shear pin and the companion tongue on the same side. Removal of the shear pin for replacement after shearing is quite simple. After cutting of the lock wire 52, the remainder of the shear pin and its bushing 38 can be unscrewed from the side walls of the drawbar. The shear block is then shifted longitudinally as necessary to align the sockets with the apertures in the side walls, and by a suitable extraction tool inserted into the portion of the shear pin remaining in the shear block, that part is extracted and withdrawn. Thereafter, new shear pins are applied and the draft rigging is ready for reuse.

Figure 4:
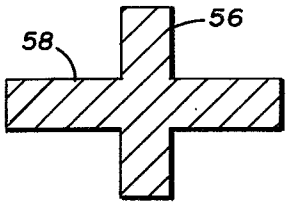
FIG. 4 is a front elevation view in cross-section, taken along lines 4—4 of FIG. 2.

In FIG. 4, there is shown the cruciform vertical section of the stem abutment member consisting of vertical and horizontal ribs 56 and 58, respectively.

From the above detailed description it will be apparent that there has been provided an improved draft rigging which not only will release for protecting itself and the underframe from the abnormal buffing forces, but is readily restorable to the initial condition by merely replacing the shear pins. It should be understood that the described and disclosed embodiment is merely exemplary of the invention and that all modifications are intended to be included that do not depart from the spirit of the invention and the scope of the appended claims.

The embodiments of the invention in which an exclusive property or privilege is claimed are defined as follows:

1. A draft rigging for a railway car comprising a drawbar having a forward and rearward end and a pocket for a cushioning means, a yoke disposed within the pocket, said yoke having a pair of transversely spaced longitudinally extending straps connected forwardly by (tie bars or) a yoke for pivotal connection to a coupler and connected rearwardly by a transverse rear wall, said rear wall having a substantially centrally located longitudinal stem abutment member extending inwardly toward the yoke head, an apertured shear block disposed between the longitudinal straps of the yoke, the longitudinal stem abutment member passing through the aperture in the shear block, the shear block being releasably secured to the drawbar.

2. A draft rigging according to claim 1, which contains in addition, a cushioning member disposed adjacent the yoke head of the yoke between the longitudinal straps.

3. A draft rigging according to claim 2 which contains in addition, a front and rear follower for the cushioning means, the front follower being in contact with the yoke head and the rear follower being in contact with the longitudinal stem abutment member.

4. A draft rigging according to claim 1 in which resilient pad means are secured to the forward end of the drawbar and extend downwardly to the head of the yoke.

5. A yoke, suitable for use in draft riggings of railway cars comprising a pair of transversely spaced longitudinally extending straps connected forwardly by a yoke head for pivotal connection to a coupler and connected rearwardly by a transverse rear wall, said rear wall having a substantially centrally located longitudinal stem abutment member, extending inwardly toward the yoke head, an apertured shear block disposed between the longitudinal straps of the yoke, the longitudinal stem abutment member passing through the aperture in the shear block.

6. A yoke according to claim 5, which contains in addition, a cushioning member disposed adjacent the yoke head of the yoke between the longitudinal straps.

7. A yoke according to claim 6, which contains in addition, a front and rear follower for the cushioning means, the front follower being in contact with the yoke head and the rear follower being in contact with the longitudinal stem abutment member.

8. A yoke according to claim 5, in which the longitudinal stem abutment member is T-shaped cross-section as viewed in side elevation.

* * * * *

UNITED STATES PATENT OFFICE

CERTIFICATE OF CORRECTION

Patent No. 4,022,329 Dated May 10, 1977

Inventor(s) Walter Cabble Dilg

It is certified that error appears in the above-identified patent and that said Letters Patent are hereby corrected as shown below:

In the Claims:

Claim 1, line 31, insert --head-- before "for pivotal connection...".

Signed and Sealed this

*Eleventh* Day of *September 1979*

[SEAL]

*Attest:*

*Attesting Officer*

LUTRELLE F. PARKER

*Acting Commissioner of Patents and Trademarks*